United States Patent [19]

Zapomel

[11] 3,958,475

[45] May 25, 1976

[54] SLICING MACHINE

[75] Inventor: Johann Zapomel, Basel, Switzerland

[73] Assignee: Bizerba-Werke Wilhelm Kraut K.G., Balingen, Wurttemberg, Germany

[22] Filed: Nov. 5, 1974

[21] Appl. No.: 521,185

[30] Foreign Application Priority Data

| | | |
|---|---|---|
| Nov. 7, 1973 | Switzerland | 15720/73 |
| Feb. 8, 1974 | Switzerland | 2007/74 |
| May 31, 1974 | Germany | 2426383 |

[52] U.S. Cl. ..... 83/112; 83/91; 83/95; 83/96; 83/161; 83/721

[51] Int. Cl.[2] ..... B26D 4/24

[58] Field of Search ..... 83/94, 95, 96, 105, 83/112, 154, 155, 155.1, 161, 431, 731, 734

[56] References Cited

UNITED STATES PATENTS

| | | | |
|---|---|---|---|
| 2,013,054 | 9/1935 | Kallos | 83/112 |
| 2,024,404 | 12/1935 | Van Berkel | 83/154 X |
| 2,095,043 | 10/1937 | Van Berkel | 83/94 |
| 2,274,628 | 2/1942 | Van Duyn | 83/161 X |
| 2,277,279 | 3/1942 | Van Berkel | 83/154 X |
| 2,296,587 | 9/1942 | Van Berkel | 83/94 X |
| 3,161,215 | 12/1964 | Werder et al. | 83/731 X |

*Primary Examiner*—J. M. Meister
*Assistant Examiner*—Fred A. Silverberg
*Attorney, Agent, or Firm*—Spencer & Kaye

[57] ABSTRACT

A slicing machine comprising a rotatable circular cutter blade, a reciprocatable feed carriage to carry stock to be sliced by the cutter blade, and a receiving device to receive slices severed by the cutter blade from such stock. The receiving device is coupled to the feed carriage to be angularly displaced in co-ordination with the reciprocation of the feed carriage and is provided with a plurality of spikes to project from a slice receiving surface of the receiving device by an amount sufficient to enable a plurality of severed slices to be stacked on the receiving device, which is further provided with stripper means to strip such stack of slices off the spikes.

12 Claims, 5 Drawing Figures

SLICING MACHINE

BACKGROUND OF THE INVENTION

The present invention relates to a slicing machine, especially for sausages and the like, comprising a rotatable circular cutter blade, a reciprocatable feed carriage to carry stock to be sliced by the cutter blade to a presettable thickness of cut and a receiving device to receive slices severed by the cutter blade from such stock, the receiving device being coupled to the feed carriage to be angularly displaced in co-ordination with the reciprocation of the feed carriage and being provided with a plurality of spikes.

In known ejector devices of slicing machines, the slices, after they have been removed from the circular cutter by the revolving receiving device are again stripped off after one half rotation of it and fall either onto the table supporting the machine or into a tray alongside the machine, or they are transported by a conveying device to a predetermined deposit position, there to be deposited on a stack or in some other type of formation. In the first case, the slices fall in an uncontrolled manner from the receiving device, so that no tidy stack is formed such as would be desired for packaging. In the second case, such a stack formation is indeed possible but the conveying and deposition devices necessitate complicated mechanisms, which make exacting demands in regard to attendance and maintenance upon the personnel operating the equipment, if the mechanisms are to function correctly. Moreover, such conveying and depositing devices are expensive.

SUMMARY OF THE INVENTION

According to the present invention, there is provided a slicing machine comprising a rotatable circular cutter blade, a reciprocatable feed carriage to carry stock to be sliced by the cutter blade, and a receiving device to receive slices severed by the cutter blade from such stock, the receiving device being coupled to the feed carriage to be angularly displaced in co-ordination with the reciprocation of the feed carriage and being provided with a plurality of spikes to project from a slice receiving surface of the receiving device by an amount sufficient to enable a plurality of severed slices to be stacked on the receiving device, which is further provided with stripper means to strip such stack of slices off the spikes.

BRIEF DESCRIPTION OF THE DRAWINGS

Embodiments of the present invention will now be more particularly described with reference to the accompanying drawing, in which.

DESCRIPTION OF THE PREFERRED EMBODIMENT

Figure 1:
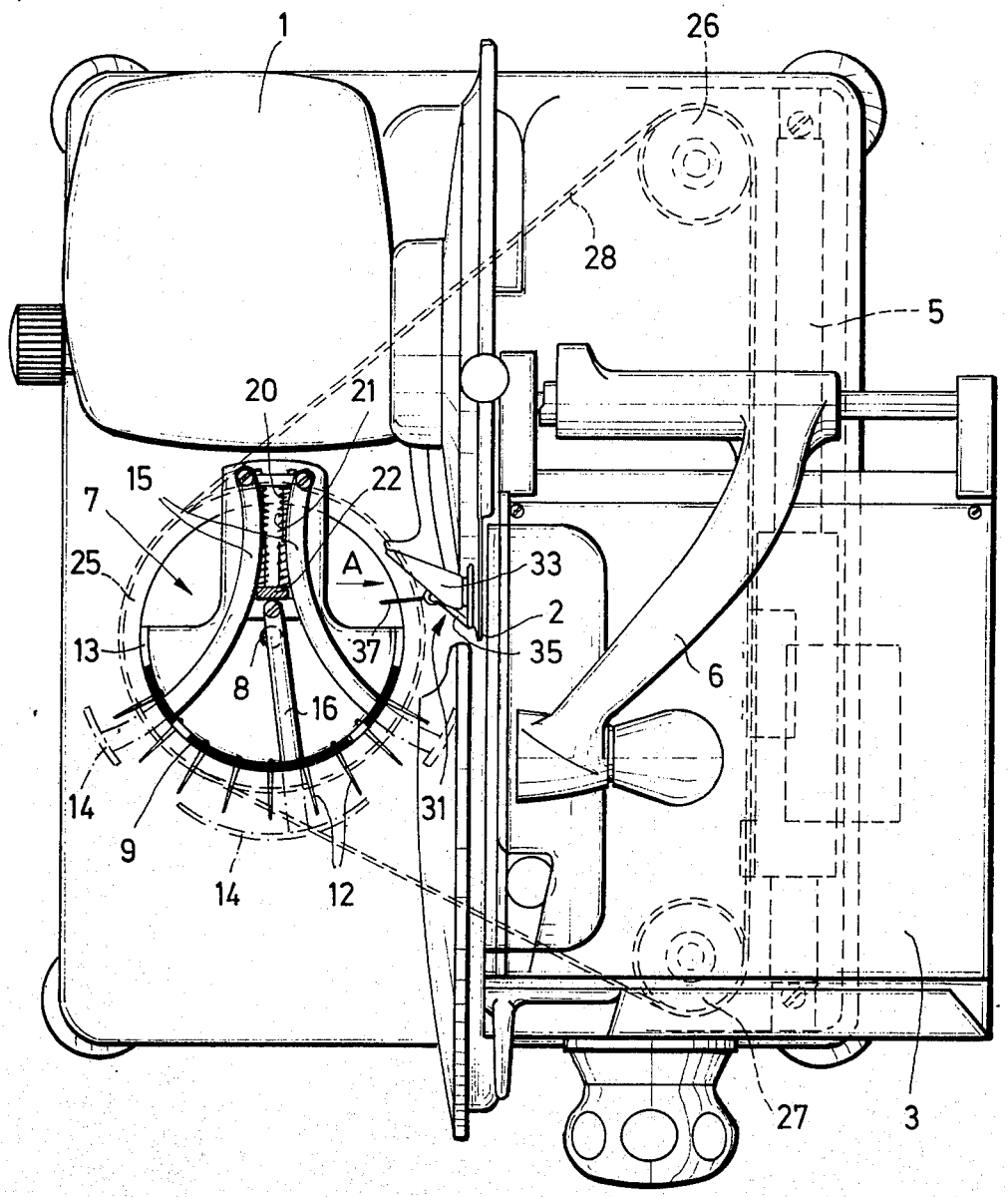
FIG. 1 shows a plan view of a slicing machine, embodying the present invention.
Figure 2:
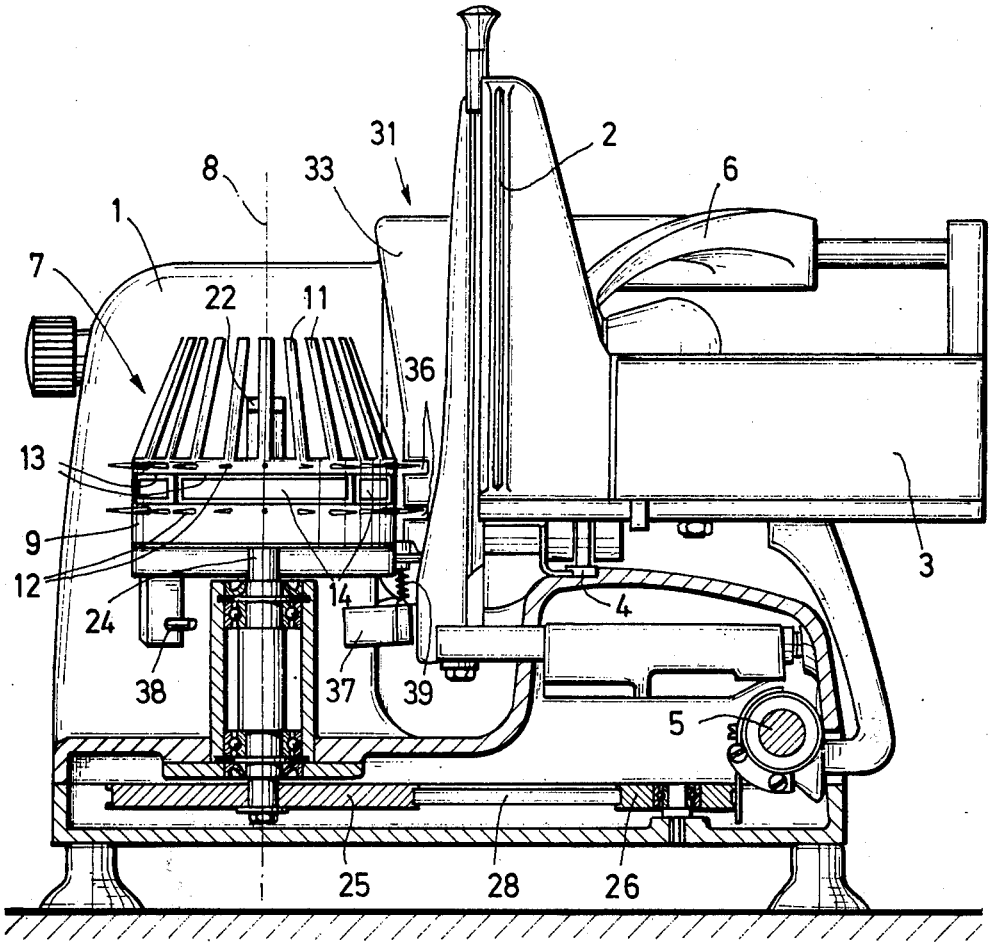
FIG. 2 shows a side elevation of the slicing machine.

Referring now to the drawings, FIGS. 1 and 2 show a slicing machine, which comprises a motor housing 1, a revolving, preferably electrically driven circular cutter blade 2 and a reciprocating feed carriage 3 for the stock or material to be sliced. This carriage is slidably mounted by guide rails 4 and 5 and comprises a pivotably mounted retaining lever 6 for pressing the stock to be sliced against the circular cutter blade 2.

Figure 3:
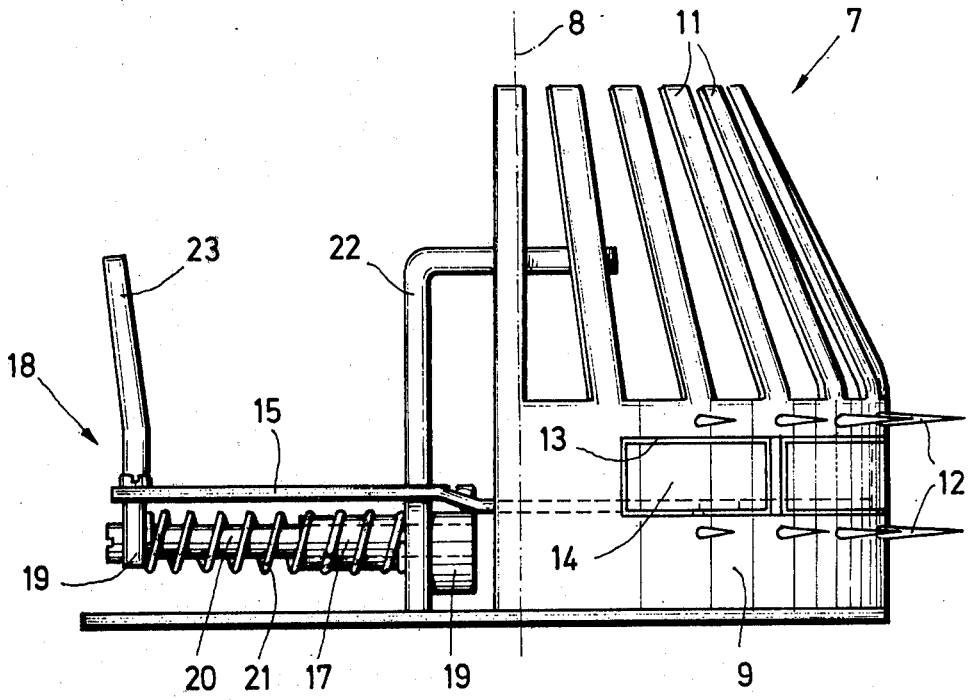
FIG. 3 shows a side elevation of a receiving device of the slicing machine.
Figure 4:
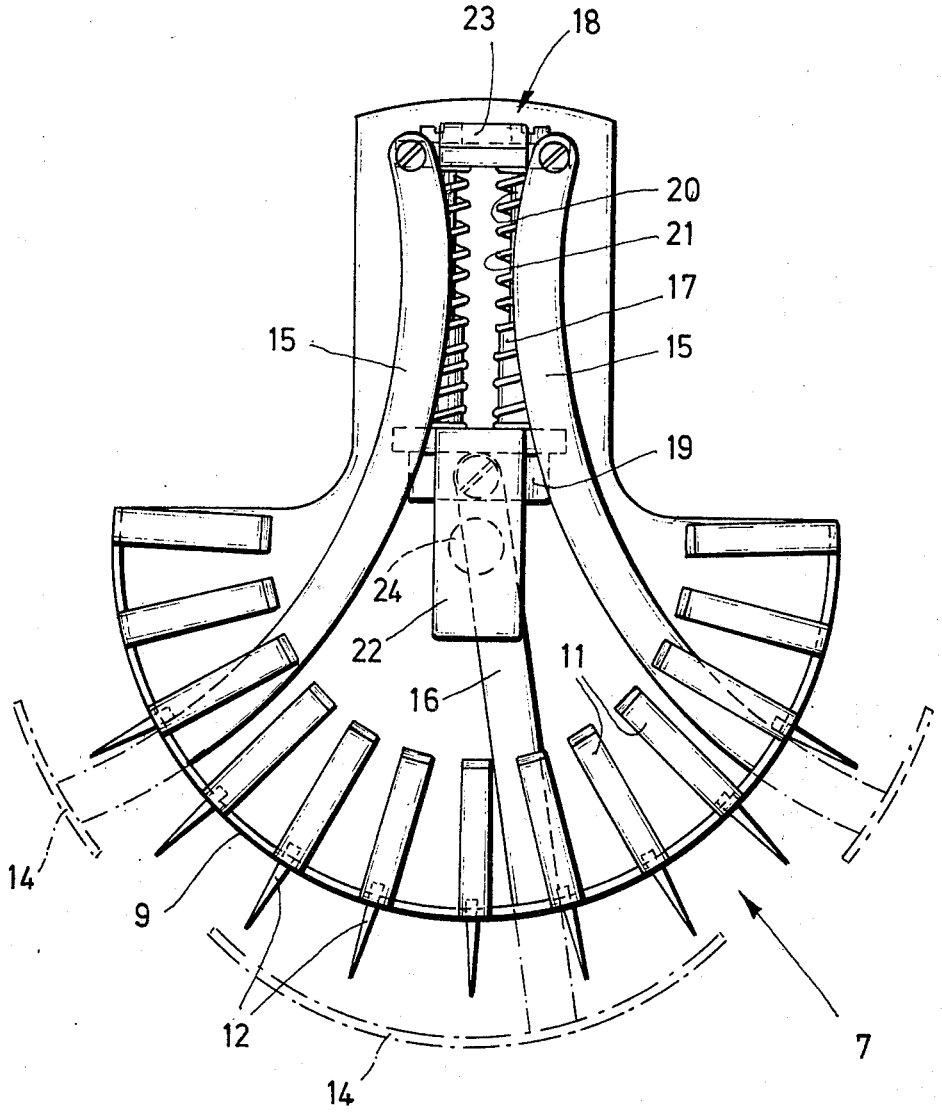
FIG. 4 shows a plan view of the receiving device.
Figure 5:
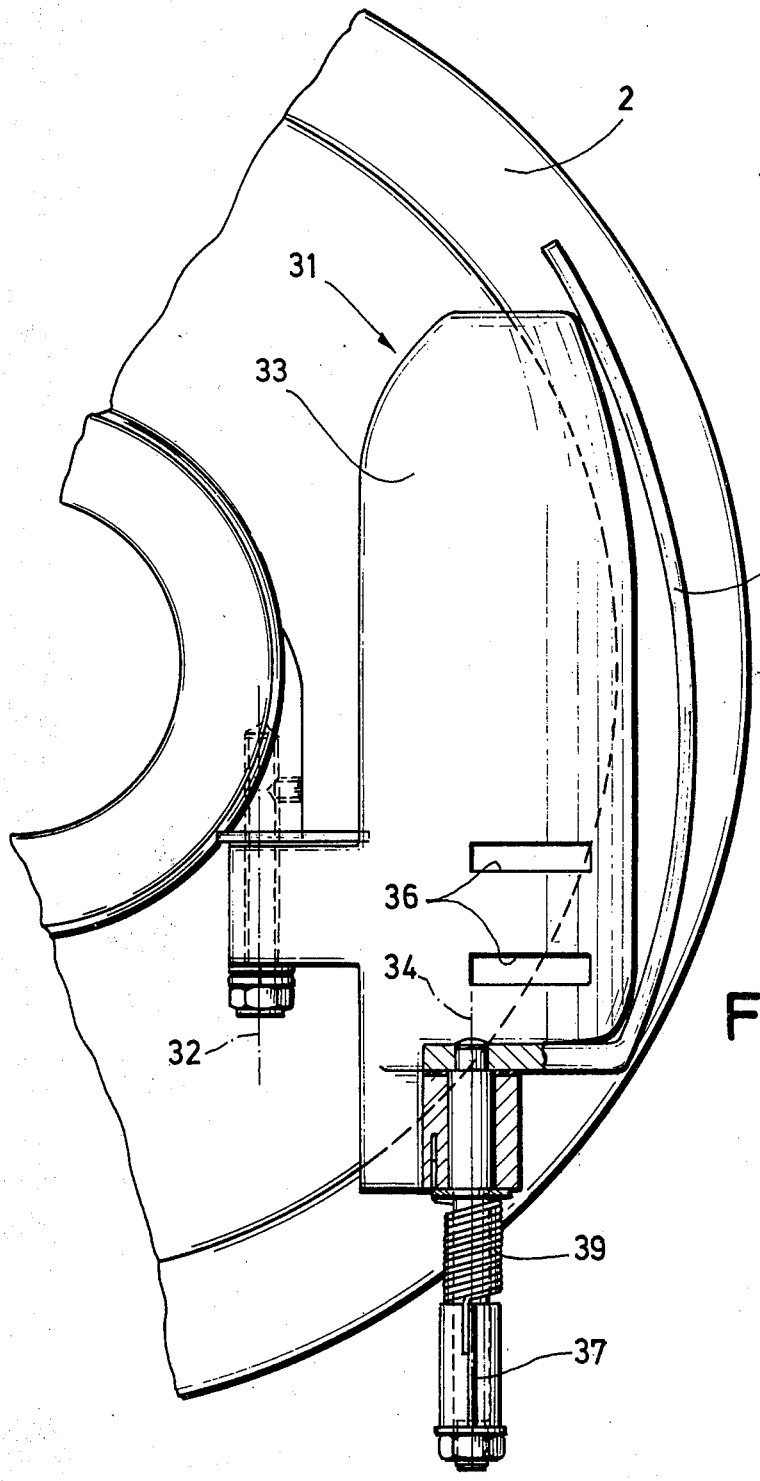
FIG. 5 shows an elevation of a guide element viewed in the direction of arrow A in FIG. 1.

On the side of the circular blade 2 remote from the feed carriage 3, a receiving device 7 is journalled to be at the level of the severing location and to be rotatable about a vertical axis 8. The receiving device comprises an approximately semi-circular cylindrical receiving surface 9, surmounted by a frusto-conical section, the axis of generation of which coincides with the rotational axis 8 (FIGS. 3 and 4). The upper, frusto-conical portion of the receiving device 9 comprises a plurality of individual inwardly bent tongues 11 and serves as a supporting surface for severed slices. In the lower cylindrical receiving surface 9, sharp spikes 12 are disposed in two rows one above the other to point radially outwards. Between the two rows of spikes, the receiving surface 9 has rectangular openings 13, in which are disposed movble segment members 14 conforming to the shape of movable receiving surface. These movable segment members are connected to be pivotable about a vertical axis by means of levers 15 and 16 rigidly attached to them, to a member 18 slidable along two guide tubes 17 towards the receiving surface and away from it. The member 18 comprises two parallel tubes 20, which are joined together by yoke-like webs 19 and which are capable of sliding in the manner of a telescope in the guide tubes 17. The guide tubes 17 are rigidly attached to the receiving device 7, whereas the slider member 18, the levers 15 and 16 and the movable segment members 14 are displaceable relative to the receiving device 7. The interfitting tubes 20 and 17 are surrounded by a helical spring 21, which bears at one end on the slider member 18 and at the other end on the receiving device 7 and which urges the slider member 18 together with the tubes 20 out of the guide tubes 17. In addition, a retaining bar 22 is connected to the receiving device 7 and a handle 23 to the slider member 18.

When the spring 21 is relaxed (expanded), the slider member 18 is at its furthest position from the receiving surface 9 and the segment members 14 are pulled back into the openings 13 of the receiving surface 9, so that they in effect form part of that surface. When the handle 23 is pushed against the force of the helical spring 21 up against the retaining bar 22, then the segment members 14 are pushed outwards of the openings 13 by the levers 15 and 16 and in a direction parallel to the radially oriented spikes 12 projecting from the receiving surface 9, thereby to strip off the slices on the spikes 12. In FIGS. 1 and 4, the levers 15 and 16 as well as the segment members 14 are shown in the extended position by dot-and-dash lines. The movable segment members together with the levers 15 and 16 and the slider member 18 thus constitute a stripper apparatus.

The receiving device 7 is keyed onto a vertical driving shaft 24, which in turn is keyed onto a sheave 25. A driving belt 28 is attached to the feed carriage 3 and passes around this sheave 25 and guide pulleys 26 and 27 (FIG. 1). By means of this belt 28, the reciprocation of the feed carriage 3 is translated into a synchronous, oscillatory rotation of the driving shaft 24 and therefore of the receiving device 7. The connection between the receiving device 7 and the driving shaft 24 is releasable, so that the receiving device 7 can easily be removed from the slicing machine, for example by gripping the retaining bar 22 and the handle 23.

It is also possible to fit the driving shaft 24 with a lockable hinge, so that unlocking the hinge enables the receiving device 7 to be pivoted perpendicularly to the driving shaft 24 without being disconnected from it; this embodiment of the invention is not shown in the drawing.

Directly behind the severing location, a guide element 31 is disposed between the circular cutter blade 2 and the receiving device 7; this guide element 31 serves for guiding and pressing the severed slices onto the receiving device 7. The guide element 31 is mounted to be pivotable about a vertical axis 32 and comprises a guide plate 33 and a pusher bar 35, attached thereto to be pivotable about a vertical axis 34 (FIG. 4). The guide plate 33 extends on its side nearest to the circular cutter blade 2 at an acute angle right up close to the circular cutter blade 2, so that it guides the severed slices away from the circular cutter. At the opposite side, the guide plate extends right up close to the receiving surface 9 of the receiving device 7. Milled into the guide plate 33 are horizontal grooves 36, through which the spikes 12 pass. By means of the guide plate 33, the cut off slices are guided so closely onto the receiving surface 9 that they are laid against that surface, the spikes 12 penetrating and holding the slices.

The pusher bar 35 is provided at its lower end with an actuating lever 37, against which an entraining member 38 mounted on the receiving device 7 strikes as it rotates, thus causing the push bar 35 to be pivoted about the axis 34 and to press against a slice pierced by one or more of the spikes 12 and force it firmly against the receiving surface 9, so that the points of the spikes 12 are then free to receive a further slice. A helical spring 39 surrounding the shaft 34 causes the pusher bar 35 then to be swung back into its rest position.

In operation, the receiving device 7 is rotationally driven by the belt 28 synchronously with the movement of the feed carriage 3, so that the circumferential speed of the receiving surface 9 and the linear speed of the feed carriage 3 are substantially equal. A slice severed by the circular cutter blade 2 can therefore be placed by the guide plate 33 against the receiving surface 9 and be firmly pushed by the pusher bar 35 onto the spikes 12. When the feed carriage 3 returns, the receiving device 7 also rotates back. When the next slice is severed, it is again pressed against the receiving surface on top of the slice already held there. In this manner, a stack of slices can be collected upon the receiving device 7 according to the quantity desired or the length of the spikes 12. As soon as the desired quantity has been reached, the receiving device 7 is removed from the driving shaft 24 and the stripper apparatus is actuated at a desired location by pushing forward the handle 23 and thus the slider 18. The receiving device 7 is then replaced on the driving shaft 24 and is ready to receive a new stack of slices.

As already described above, it is also possible not to remove the receiving device 7 from the driving shaft 24, but to pivot it about a lockable hinge. It is also possible to effect the releasing of the hinge, the pivoting of the receiving device 7 and the actuating of the stripper apparatus in such a case by a drive powered by the slicing machine.

I claim:

1. A slicing machine, comprising, in combination:

a frame;

a circular cutter blade rotatably mounted on said frame;

a feed carriage slidably mounted on said frame to feed stock supported on said carriage towards said blade;

a device to receive individual slices of said stock sequentially sliced by said blade, said device including a rotatably mounted body, a plurality of spikes mounted on said body to project therefrom by an amount sufficient to penetrate a plurality of said slices, and means to strip said slices from spikes, said stripper means including a movable member having a surface portion, and movable between a first position of said member and a second position, said member being movable in a direction substantially parallel to the longitudinal direction of said spikes to the second position, which is spaced from said first position by at least the length of said spikes, guide means, a member slidable along a path defined by said guide means, and a respective lever linkage connecting said movable member to said slidable member; and drive means to reciprocally displace said carriage and to angularly displace said body in such coordination with said diplacement of said carriage, that slices of said stock sequentially sliced by said blade are successively impaled on said spikes to form thereon a stack of slices, which may subsequently be detached from said receiver device by said stripper means.

2. A slicing machine as defined in claim 1 wherein the surface portion of the movable member in the first position of such member forms part of a slice receiving surface of said body and conforms in shape to adjacent surface portions thereof.

3. A slicing machine as defined in claim 1, wherein said stripper means include a plurality of such movable members and means to displace said movable members together from their respective first positions to their respective second positions.

4. A slicing machine as defined in claim 1, wherein said slidable member is provided with a handle to enable it to be displaced manually.

5. A slicing machine as defined in claim 1, comprising resilient means acting on said slidable member to urge said movable member into said first position.

6. A slicing machine as defined in claim 1, wherein said receiving device and said stripper means are as a unit detachably connected to said frame of said slicing machine.

7. A slicing machine as defined in claim 1, comprising a drive belt connecting said receiving device with said feed carriage in such a manner that - in use of said machine - reciprocation of said feed carriage and oscillating rotation of said receiving device take place synchronously.

8. A slicing machine, comprising, in combination:

a frame;

a circular cutter blade rotatably mounted on said frame;

a feed carriage slidably mounted on said frame to feed stock supported on said carriage towards said blade;

a device to receive individual slices of said stock sequentially sliced by said blade, said device including a rotatably mounted body, a plurality of spikes mounted on said body to project therefrom by an amount sufficient to penetrate a plurality of said slices, and means to strip said slices from spikes;

a guide element to urge slices coming from said cutter blade onto said spikes, said guide element including a stationary guide plate and a pivotably mounted pusher member actuable by said receiving device to urge individual severed slices toward said spikes; and drive means to reciprocally displace said carriage and to angularly displace said body in such coordination with said displacement of said carriage, that slices of said stock sequentially sliced by said blade are successively impaled on said spikes to form thereon a stack of slices, which may subsequently be detached from said receiver device by said stripper means.

9. A slicing machine as defined in claim 1, wherein said spikes project from a substantially cylindrical portion of said body and wherein said body is provided with a frustoconical portion concentric with and next adjacent to said cylindrical portion.

10. A slicing machine as defined in claim 8, wherein said guide plate is provided with grooves, which — on angular displacement of said receiving device in use of said machine — are traversed by said spikes.

11. A slicing machine as defined in claim 8, wherein said guide plate is provided with slots, which — on angular displacement of said receiving device in use of said machine — are penetrated by said spikes.

12. A slicing machine as defined in claim 8, wherein said pusher member is provided with an actuating lever, which — on angular displacement of said receiving device in use of said machine — is entrained by entraining means provided on said receiving device.

* * * * *